US005890444A

United States Patent [19]

Martin et al.

[11] Patent Number: 5,890,444

[45] Date of Patent: Apr. 6, 1999

[54] METHOD FOR DETERMINING THE AVERAGE RADIATION OF A BURNING BED IN COMBUSTION INSTALLATIONS AND FOR CONTROLLING THE COMBUSTION PROCESS

[75] Inventors: Johannes Martin; Walter Martin, both of Munich, Germany

[73] Assignee: Martin GmbH fuer Unwelt- und Energietechnik, Munich, Germany

[21] Appl. No.: 124,645

[22] Filed: Jul. 29, 1998

[30] Foreign Application Priority Data

Aug. 13, 1997 [DE] Germany ..... 197 35 139.5

[51] Int. Cl.[6] ..... F23G 5/00

[52] U.S. Cl. ..... 110/346; 110/347; 110/190; 236/15 BB; 236/15 E

[58] Field of Search ..... 110/185, 190, 110/346, 347; 236/15 BA, 15 BB, 15 E

[56] References Cited

U.S. PATENT DOCUMENTS

| | | | |
|---|---|---|---|
| Re. 33,857 | 3/1992 | Ariessohn et al. | 358/113 |
| 4,737,844 | 4/1988 | Kohola et al. | 358/100 |
| 5,139,412 | 8/1992 | Kychakoff et al. | 431/12 |
| 5,606,924 | 3/1997 | Martin et al. | 110/190 X |
| 5,634,412 | 6/1997 | Martin et al. . | |
| 5,794,549 | 8/1998 | Carter | 110/347 |

*Primary Examiner*—Henry A. Bennett
*Assistant Examiner*—Susanne C. Tinker
*Attorney, Agent, or Firm*—McAulay Nissen Goldberg Kiel & Hand, LLP

[57] ABSTRACT

For determining the average radiation of a surface region of a burning bed, an infrared camera is used in a firing installation, which camera is aligned with this region and is equipped by means of appropriate flame filters in such a way that it operates at the minimum of the interfering radiation emanating from the flame, whereby this interfering radiation is already largely eliminated. In order then also to eliminate the solids radiation from moving particles and thus to obtain a temperature measurement of the burning bed, recordings are made successively at short intervals of time by means of the infrared camera and these are evaluated in the evaluation and control device. For calculating an average value of the radiation or of the average temperature, only those part surfaces of the surface region subdivided into a plurality of part surfaces are here taken into account which are not subject to any change and can thus be allocated to the burning bed which is to be regarded as being essentially at rest, while the varying radiation results from other part surfaces are to be ascribed to the solids radiation of moving particles, such as, for example, dust particles and soot particles, which falsify the temperature of the burning bed.

9 Claims, 4 Drawing Sheets

METHOD FOR DETERMINING THE AVERAGE RADIATION OF A BURNING BED IN COMBUSTION INSTALLATIONS AND FOR CONTROLLING THE COMBUSTION PROCESS

BACKGROUND OF THE INVENTION

1. Field of the Invention

The invention relates to a method for determining the average radiation and the average temperature, associated with this radiation, of a surface region of a burning bed by means of an infrared camera or thermographic camera in combustion installations and for controlling the combustion process at least in the observed surface region of this combustion installation.

2. Description of the Related Art

Known methods of this type are evident from DE 3,904,272 C2 and DE 4,220,149 A1. In practice, difficulties have arisen in carrying out these methods, the difficulties being that the values of radiation and/or temperature detected do not always correspond to the exact temperature values of the burning bed, because they are affected by the radiation values of the flames, flue gases and soot particles present between the infrared camera and the burning bed. This has the consequence that the control operations carried out on the basis of such control parameters on the combustion processes frequently do not meet the desired requirements.

OBJECT AND SUMMARY OF THE INVENTION

It is the primary object of the invention to develop a method of the type indicated above in such a way that the interference by flame radiation, radiation from the gases present in the flue gases and solids radiation from soot particles and the like are largely excluded.

According to the invention, this object is achieved, starting from a method of the type explained above, by restricting the measurement to a wave region which corresponds to the minimum of the interfering gases above the burning bed, subdividing the surface region to be covered into a surface pattern with a plurality of part surfaces, recording a plurality of successive images within a period of time during which, in the surface region to be covered, the burning bed can be assumed to be at rest and the radiation or temperature of the burning bed can be assumed to be almost constant, discriminating between the part surfaces with radiation from radiating media at rest and the part surfaces with radiation from moving radiating media by means of a comparison of the images during one period of time, and utilizing only the radiation or temperature of the part surfaces of the radiation of radiating media at rest for the calculation of the average radiation or average temperature of the surface region.

The invention thus exploits two fundamental considerations, one fundamental idea being to establish the radiation intensity of at least those gases which occur most frequently by a spectral analysis, to determine the minimum of this radiation intensity of the gases and to tune the measurement instrument used in the form of infrared cameras or thermographic cameras to this wave region, in order thus to eliminate a major part of the interfering gas radiation. The second fundamental idea is to eliminate the radiation, which is present between the burning bed and the measurement instrument and which emanates, for example, from solid particles, in particular from soot, or from individual gas components, by successively recording a plurality of images of a surface region subdivided into a surface pattern within short intervals of time and thereby rejecting those part surfaces of the surface pattern for the formation of the average which are subject to wide fluctuations. The starting point here was the consideration that the burning bed is almost immovable, while the radiating solid particles or gases are subject to vigorous motion if sufficiently small intervals of time are used as a basis for measurement. The burning bed thus to be regarded as being at rest is not subject to any wide temperature fluctuations, even within short intervals of time of a few tenths of a second, so that it can be assumed, in the case that conspicuous temperature fluctuations do occur, that interfering radiations arise between the burning bed and the measurement instrument. If those images, which are affected by the radiation from moving particles or gases, are thus rejected for the evaluation of the radiation, a largely unaffected average value is obtained for the radiation from a surface region, corresponding to a defined temperature value which can be used as the control parameter for influencing the most diverse parameters which affect the combustion process. All parameters known so far can thus be influenced, essential parameters among these being indicated below in a list which is not exhaustive. Such parameters can be: the total air rate fed to the combustion process, the rate of primary air, the air rate distribution in the primary air, the oxygen concentration in the the primary air, the temperature of the primary combustion air, the fuel feed rate in total or relative to certain sections of the firing grate, the stoking speed of the firing grate as a whole, the local stoking speed of the firing grate, and so on.

For carrying out the method according to the invention it is advantageous when a control parameter for controlling some or all processes hitherto controllable as a direct or indirect function of the combustion temperature is formed from the detected measured values by means of fuzzy logic.

In order to suppress sudden control actions, it is advantageous when, in a further development of the invention, a mean of the average radiation or average temperature is formed from a plurality of successive periods of time for establishing the control parameter. One period of time can be about 0.1 to 5 seconds.

The mean of the average values of 5 successive periods of time has proved to be a measure, suitable in practice, for establishing the control parameter.

The surface area region to be observed should amount to at least 1 $m^2$ and be subdivided into a surface pattern with at least 10 part surface areas. For grate firing installations, it has proved to be advantageous if the surface area pattern corresponds to the primary air zones of the grate region active for the combustion.

The method according to the invention is also suitable in a particularly advantageous manner for monitoring the correct operation of a firing grate. For this purpose, in the case of radiation values or temperature values of individual part surfaces widely deviating from the average value of a period of time, these radiation and/or temperature values of the respective part surfaces are observed over a plurality of periods of time and the corresponding images of the part surfaces are compared with one another with respect to deviations. Thus, if a certain part surface always shows a value widely deviating from the average value over a plurality of periods of time, i.e. for example shows much too high a temperature, this can indicate a mechanical defect and hence a concomitant poor distribution of the air feed. If, however, the temperature is always too low in one region, this can indicate a blockage and hence a primary air feed which is much too low.

The infrared camera or thermographic camera used is equipped by means of filters in such a way that it operates within a wave range from 3.5 to 4 $\mu$m. In this region, the emission intensity of the gases usually occurring in a firing chamber is at a minimum. These gases are $CO_2$, CO and water vapor. Although the soot, which is not always avoidable, is in this wavelength region a lower value than in a smaller wave region, it represents a considerable source of interference, which is eliminated by means of the method measures explained at the outset. The evaluation device downstream of the camera, having a fuzzy control system, is arranged in such a way that the images obtained or the measured signals obtained are fuzzied, subjected to an inference method and then defuzzied. The result is a relative quality of the image information which very closely approaches the actual state of the surface of the burning bed. In the software, a threshold is established, below which an infrared image is defined as being no longer capable of evaluation. Above this threshold, the radiation data or temperature data obtained are passed on without further assessment of the image quality. In the case of poor image quality, for example for longer than two minutes, the camera control loops are taken out of action and then reactivated via the image assessment. This is intended to prevent a control action not corresponding to the actual conditions from taking place due to poor images. This can be the case, for example, when excessive soot evolution, which forms a virtually continuous layer between the burning bed and the infrared camera, does not permit "looking through" this layer due to the absence of "windows", i.e. a useful image assessment. Such states last only a short while and, in addition, such states can be avoided by providing a plurality of infrared cameras which point at the burning bed under different angles of view.

The invention is explained below by way of example in conjunction with the drawing.

DESCRIPTION OF THE PREFERRED EMBODIMENTS

Figure 1:
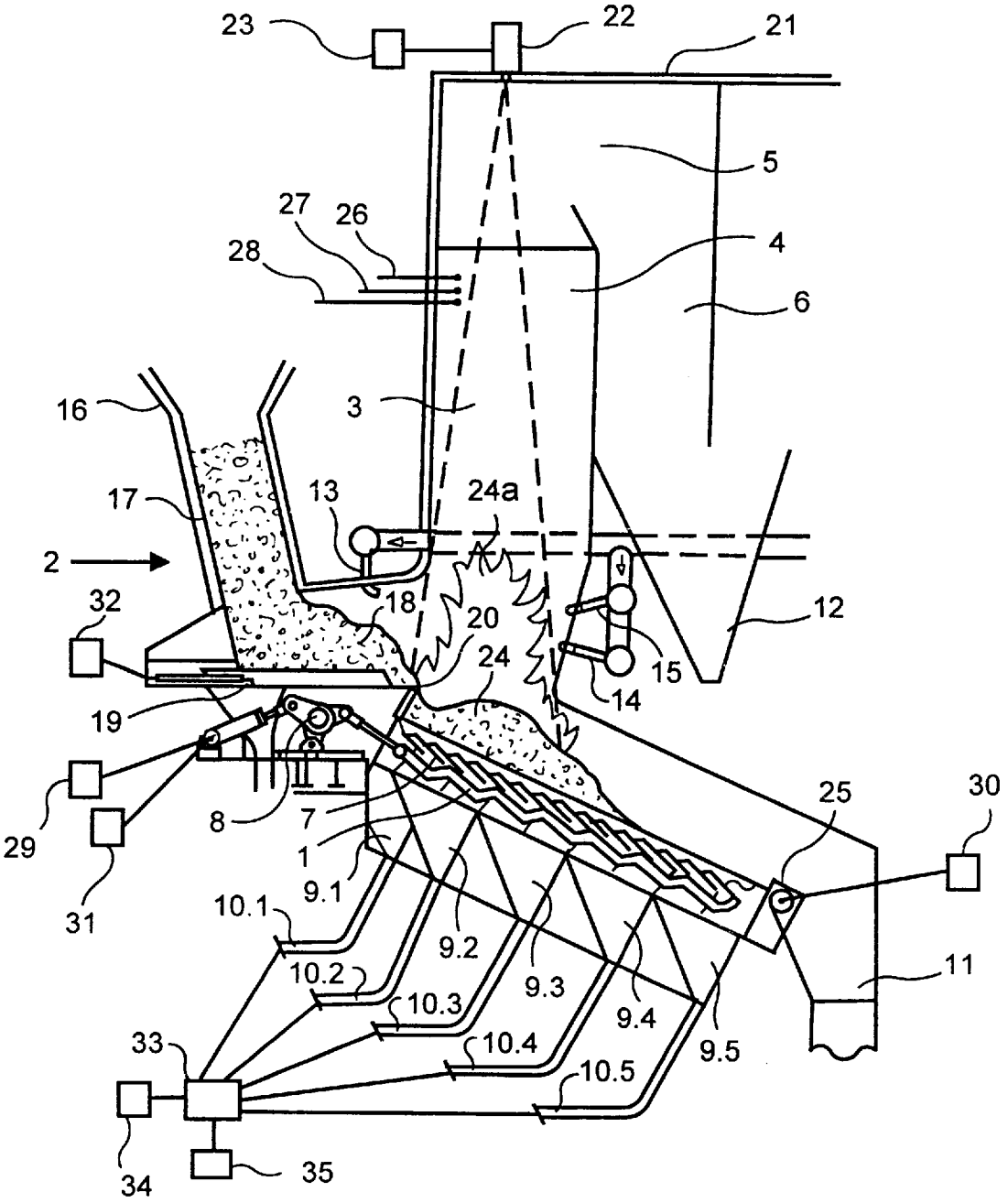
FIG. 1 shows a vertical section through a diagrammatically represented firing installation with equipment for carrying out the method according to the invention.
Figure 2:
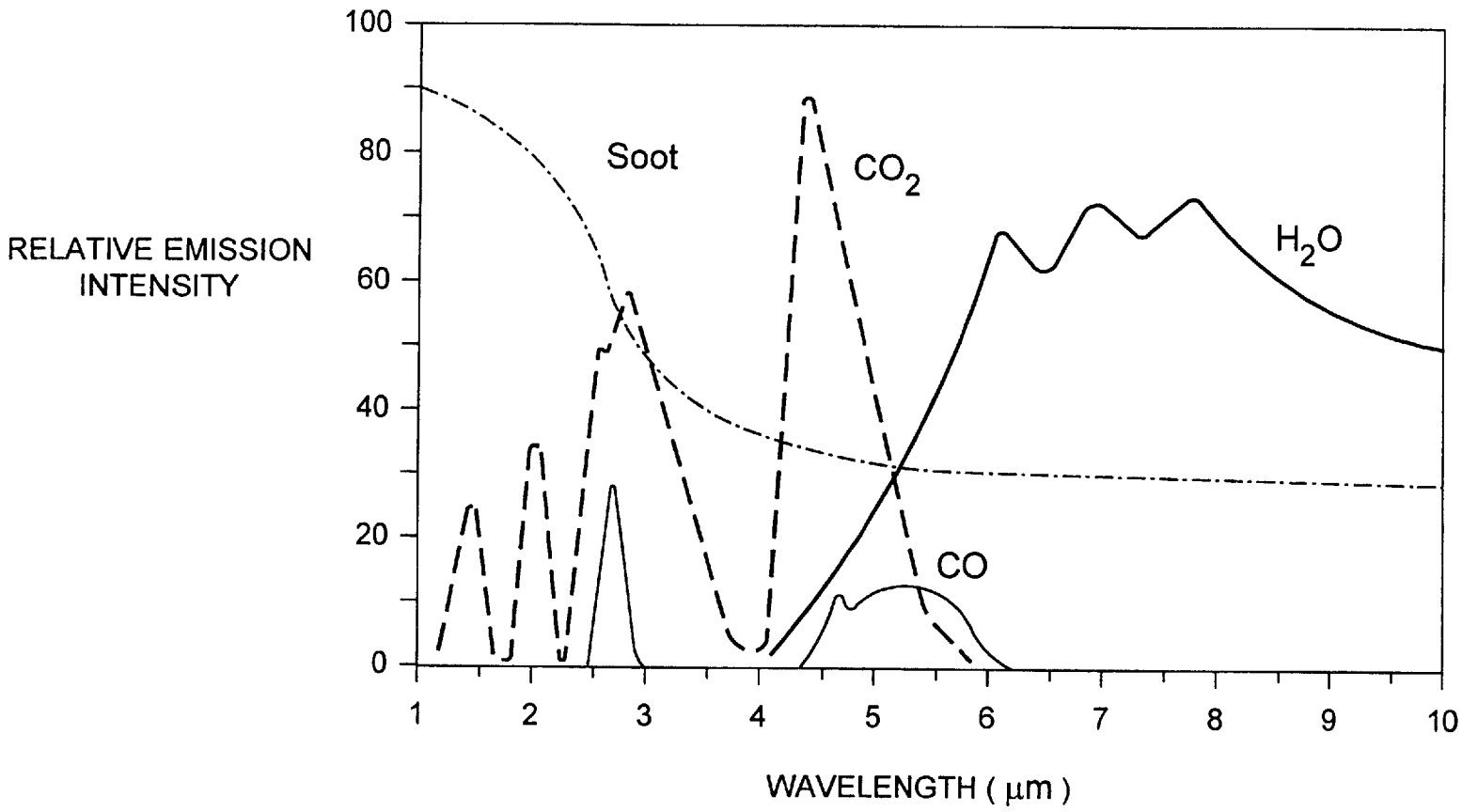
FIG. 2 shows a radiation diagram of various gases.

The firing installation shown in FIG. 1 comprises a firing grate 1, a charging device 2, a fire chamber 3 with adjoining gas flue 4 and a reversal chamber 5 in which the flue gases are passed into a downward-directed gas flue 6 from which they pass into the customary downstream units of a firing installation, in particular steam generators and flue gas purification plants.

The firing grate 1 comprises individual grate steps 7 which in turn are formed by individual adjacent grate bars. Every second grate step of the firing grate designed as a reciprocating grate is connected to a drive which is marked 8 as a whole and which enables the stoking speed to be adjusted. Underneath the firing grate 1, under-grate blast chambers 9.1 to 9.5 are provided, which are subdivided both in the longitudinal direction and in the transverse direction and which are separately fed with primary air via individual lines 10.1 to 10.5. At the end of the firing grate, the burnt-out slag drops over a slag roller 25 into a slag drop shaft 11 which is also reached, if appropriate, by the heavier solids fractions precipitated from the flue gas in the lower reversal chamber 12.

A plurality of rows of secondary air nozzles 13, 14 and 15 point into the firing chamber 3, and these ensure a controlled combustion of the flammable gases and of the fuel fractions in suspension by feeding so-called secondary air. These rows of secondary air nozzles can be separately controlled since, distributed across the firing chamber, different conditions prevail.

The charging device 2 comprises a charging hopper 16, a charging chute 17, a charging table 18 and one or more charging pistons 19 which are positioned next to each other and, if appropriate, are controllable independently of one another and which push the refuse dropping down in the charging chute 17 via the charging edge 20 of the charging table 18 into the firing chamber onto the firing grate 1.

In the ceiling 21, which closes off the upper reversal chamber 5, an infrared camera 22 is mounted which is connected to a device 23 which serves for the evaluation of the received images, formation of a control parameter and issue of control commands for the various devices of the firing installation for influencing the combustion process. 23 also designates an evaluating and controlling device.

The infrared camera 22 serves for detecting the radiation emanating from a burning bed 24 located on the firing grate 1 and/or for establishing the burning-bed temperature associated with the burning-bed radiation. Interference due to the flame 24*a* and/or the gaseous and solid constituents contained in the flue gases are here largely excluded, as will be explained in more detail further below.

The fuel heaped up on the firing grate and forming the burning bed 24 is pre-dried by the under-grate blast zone 9.1 and is heated and ignited by the radiation prevailing in the firing chamber. The main burning zone is in the region of the under-grate blast zones 9.2 and 9.3, while the slag forming burns out in the region of the under-grate blast zone 9.4 and 9.5 and passes then into the slag drop shaft. The gases rising from the burning bed still contain flammable fractions which are completely burned by the addition of secondary air through the secondary air nozzle rows 13 to 15. The charging rate of the fuel, the primary air rates in the individual under-grate blast zones and their composition with respect to the oxygen content are controlled as a function of the burn-off behavior, which depends on the calorific value of the fuel and, in the case of refuse, is subject to wide fluctuations, the radiation emanating from the burning bed and the temperature linked thereto, which is detected by means of the infrared camera 22 and evaluated by the evaluating and controlling device 23 and passed on to the corresponding final control elements, being utilized for establishing the required control parameter.

Various final control elements are indicated in FIG. 1 in a diagrammatic form, 29 designating the final control element for influencing the grate speed, 30 designating the final control element for influencing the speed of rotation of the slag roller, 31 designating the final control element for influencing the grate speeds with respect to different tracks, 32 designating the final control element for the switching-on and switching-off frequency and/or the speed of the charging pistons, 33 designating the final control element for the adjustment of the primary air rate, 34 designating the final control element for adjusting the composition of the primary air with respect to the oxygen content and 35 designating the final control element for adjusting the temperature of an air preheater for the primary air.

The method according to the invention is explained in more detail below with reference to the FIGS. 1 to 6.

In FIG. 1, the infrared camera 22 and its alignment relative to the burning bed are shown. First of all, the radiation behavior of the gases and solids particles to be encountered in the firing chamber 3 is investigated in accordance with FIG. 2. Corresponding to FIG. 2, it is found that infrared a minimum of infrared radiation for the gases $CO_2$, CO and $H_2O$, which are present in high concentrations owing to the drying and combustion reaction of the fuel, in the wave region between 3.5 and 4 $\mu$m. Accordingly, the infrared camera is equipped with a wavelength-selective filter which operates at the minimum of these interfering gases, that is to say in the range from 3.5 to 4 $\mu$m. It can also be seen from FIG. 2 that the radiation intensity or the emission intensity of the solids particles (soot) in the flame 24*a* in the firing chamber 3 admittedly falls from an initially high value, a relatively low value already being reached first at 3.5 $\mu$m and then remaining approximately constant, so that the interfering radiation emanating from dust particles and/or soot cannot be eliminated by corresponding filters.

It is here, where the essential fundamental idea of the present invention now starts, and this is explained in connection with FIGS. 3 to 5.

Figures 3, 4, 5:
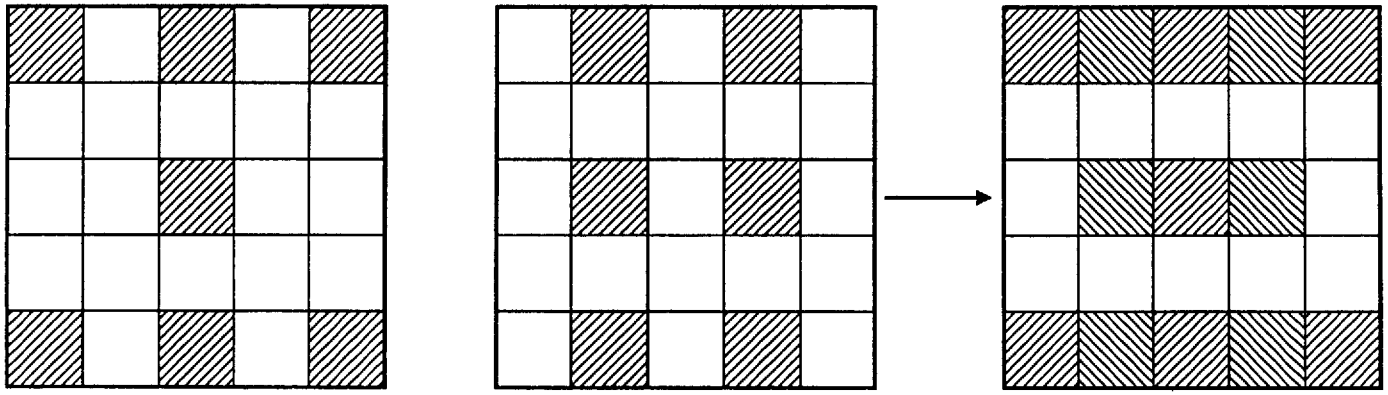
FIGS. 3 to 5 show diagrammatically represented image sequences and their assessment.

FIG. 3 shows a surface region which is monitored by an infrared camera and which is subdivided in accordance with a surface pattern into 25 part surfaces. The dark part surfaces here represent those surfaces which show substantially higher radiation intensity and hence a higher temperature than the bright part surfaces. The reason for this is that the surface of the burning bed is relatively cool as compared with the gas atmosphere lying above it. Looking then at FIG. 4, it is found that other part surfaces here show this high radiation intensity or temperature. FIG. 4 represents an image which was recorded a few tenths of a second later and thus comprises those changes which can occur within this short period of time. If it is then found that the distribution of radiation and/or temperature in FIG. 4 differs from that in FIG. 3, these deviations can originate only from those radiating media which can change both their temperature and their position within a short time. It is certain that this does not include the burning bed, since no noticeable change in position nor a drastic temperature change can occur in the burning bed within a fraction of a second. Comparing FIGS. 3 and 4, it is then found that, corresponding to FIG. 5 which shows an evaluation of this comparison, those part surfaces are drawn dark which, either in the image according to FIG. 3 or according to FIG. 4, showed a substantially higher radiation and thus a higher temperature. The fields remaining bright in FIG. 5 thus correspond to those part surfaces of the image of the surface region to be observed which have remained unchanged even after a certain length of time. It can be concluded from this that these are radiation images or temperature measurements which originate from a medium which is not subject to any sudden changes and can thus be regarded as the real radiation of the burning bed. In practice, for example for forming a control parameter which is issued by the evaluation and control device 23 to the various final control elements, seven images are recorded within 3.5 seconds and from these a mean is formed in accordance with the comparison shown in FIGS. 3 to 5. Five of such means are then combined to give a control parameter. In the present example, this means that a new control parameter is available every 17.5 seconds. Of course, the time intervals during which the individual recordings are made, can be adapted to the particular conditions, so that it is also possible to operate at substantially shorter time intervals. The part surface which is observed by an infrared camera corresponds in practice to that area which takes in at least two under-grate blast zones right up to 15 under-grate blast zones. In practice, the area of one under-grate blast zone region is about 2–4 $m^2$, this area then first being divided according to the actually present primary air zones observed by the camera and then each of these image segments corresponding to one primary air zone being subdivided for the evaluation into about 25 part surfaces in accordance with the explanations in conjunction with FIGS. 3 to 5. This subdivision and the indicated time intervals for every two successive recordings have, in connection with a firing installation having a reciprocating grate, proved to be sufficient for establishing the temperature of the burning bed.

The images corresponding to FIGS. 3 to 5 are stored over a plurality of periods of time and compared with one another, the point being not only the detection of the burning-bed temperature represented in FIGS. 3 to 5 by the bright part surfaces, but it is also possible with this method to establish whether there are any abnormal changes. If, for example, always the same part surfaces are always too high or too low in temperature over a prolonged period of time when compared with the mean burning-bed temperature on the grate region in consideration, it is possible to infer a fault in the grate mechanics or in the air feed.

Figure 6:
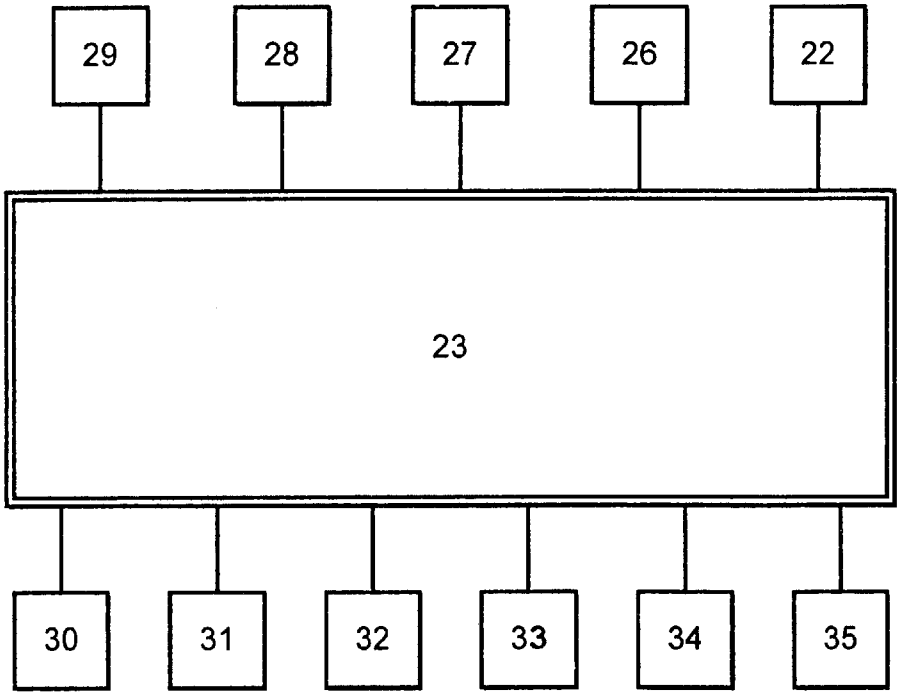
FIG. 6 shows a control system for a firing installation.

The successive control parameters formed in the evaluation and control device 23 are used for influencing the individual final control elements, as is shown in FIG. 6 as a diagrammatic overview. Accordingly, the final control elements for the grate speed 29 right up to the temperature in the air preheater 35, which has already been indicated above, can be influenced by the control device 23.

While the foregoing description and drawings represent the present invention, it will be obvious to those skilled in the art that various changes may be made therein without departing from the true spirit and scope of the present invention.

What is claimed is:

1. A method for determining the average radiation and the average temperature, associated with this radiation, of a surface region of a burning bed by means of an infrared camera or thermographic camera in combustion installations and for controlling the combustion process at least in the observed surface region of this combustion installation, which comprises the steps of:

restricting the measurement to a wave region which corresponds to the minimum of the interfering gases above the burning bed;

subdividing the surface region to be covered into a surface pattern with a plurality of part surfaces;

recording a plurality of successive images within a period of time during which, in the surface region to be covered, the burning bed can be assumed to be at rest and the radiation or temperature of the burning bed can be assumed to be almost constant;

discriminating between the part surfaces with radiation from radiating media at rest and the part surfaces with a radiation from moving radiating media by means of a comparison of the images during one period of time; and utilizing only the radiation or temperature of the part surfaces of the radiation of radiating media at rest for the calculation of the average radiation or the average temperature of the surface region.

2. The method as claimed in claim 1, wherein a control parameter for controlling some or all processes hitherto controllable as a direct or indirect function of the combustion temperature is formed from the detected measured values by means of fuzzy logic.

3. The method as claimed in claim 1, wherein, for establishing the control parameter, a mean of the average radiation or average temperature is formed from a plurality of successive periods of time.

4. The method as claimed in claim 1, wherein one period of time amounts to 0.1 to 5 seconds.

5. The method as claimed in claim 3, wherein the mean of the average values of five successive periods of time is formed for establishing the control parameter.

6. The method as claimed in claim 1, wherein a surface area region to be observed amounts to at least 1 $m^2$ and is subdivided into a surface pattern with at least ten part surface areas.

7. The method as claimed in claim 6, wherein, in the case of grate firing, the surface pattern corresponds to the primary air zones of the grate region active for the combustion.

8. The method as claimed in claim 1, wherein, in the case of radiation values or temperature values of individual part surfaces widely deviating from the average value of a period of time, these radiation and/or temperature values of the respective part surfaces are observed over a plurality of periods of time and the corresponding images of the part surfaces are compared with one another with respect to deviations.

9. The method as claimed in claim 1, wherein the radiation measurement is carried out within a spectral region of from 3.5 to 4 $\mu$m.

* * * * *

UNITED STATES PATENT AND TRADEMARK OFFICE

CERTIFICATE OF CORRECTION

PATENT NO. : 5,890,444
DATED : April 6, 1999
INVENTOR(S) : Johannes J.E. Martin et al It is certified that error appears in the above-identified patent and that said Letters Patent is hereby corrected as shown below:

Column 5, line 10, delete "infrared" (first occurrence) and insert --there is--.

Signed and Sealed this

Seventh Day of September, 1999

*Attest:*

Q. TODD DICKINSON

*Attesting Officer*

*Acting Commissioner of Patents and Trademarks*